United States Patent [19]

Sevastakis

[11] 4,285,388

[45] Aug. 25, 1981

[54] COOLING SYSTEM FOR CONTINUOUS CASTING OF BAR PRODUCTS

[76] Inventor: Gus Sevastakis, 5645 Angola Rd., Toledo, Ohio 43615

[21] Appl. No.: 974,317

[22] Filed: Dec. 29, 1978

[51] Int. Cl.[3] ..... B22D 11/00

[52] U.S. Cl. ..... 164/444; 164/348; 164/487

[58] Field of Search ..... 164/443, 444, 82, 89, 164/348

[56] References Cited

U.S. PATENT DOCUMENTS

| | | | |
|---|---|---|---|
| 2,169,893 | 8/1939 | Crampton et al. | 164/443 X |
| 3,098,269 | 7/1963 | Baier | 164/444 |
| 3,527,287 | 9/1970 | Huber | 164/443 |

FOREIGN PATENT DOCUMENTS

| | | | |
|---|---|---|---|
| 201250 | 6/1958 | Austria | 164/443 |

*Primary Examiner*—R. L. Spruill
*Assistant Examiner*—Gus T. Hampilos
*Attorney, Agent, or Firm*—William E. Mouzavires

[57] ABSTRACT

An improved cooling system for continuous casting through means of a hollow cylindrical die through the top of which molten metal is poured and from the bottom of which emerges a continuously cast bar conforming to the internal configuration of the die. The cooling system includes a cooling sleeve surrounding and continuously engaging the external surface of the die to withdraw heat from the die. The external surface of the cooling sleeve is provided with a series of grooves arranged in a continuous spiral or helix to increase the surface contact with a coolant which is circulated from an inlet upwardly along the cooling sleeve, as well as downwardly along the cooling sleeve to also contact the bar which is cast as it emerges from the die. Surrounding the cooling sleeve is a jacket and the space between the cooling sleeve and the jacket is divided by a partition to direct cool water which may be used as the coolant. In addition, a second coolant circuit is provided which may use a coolant other than water if desired and which directs the coolant through the cooling sleeve through apertures in the die through longitudinal grooves formed on the internal surface of the die so as to cool the lower portion of the die as well as the cast bar emerging therefrom.

1 Claim, 3 Drawing Figures

COOLING SYSTEM FOR CONTINUOUS CASTING OF BAR PRODUCTS

BACKGROUND OF INVENTION

In the continuous casting of metallic bar products through vertical hollow dies, it is common to employ a cooling jacket about the die to cool the die by means of a coolant such as water introduced into the area enclosed by the cooling jacket so as to come in contact with a cooling sleeve which surrounds and intimately engages the external surface of the die to withdraw heat therefrom. Effective cooling is not only necessary in order to prolong the life of the die but is also necessary to the achievement of satisfactory production speed and to this end, the continuously cast bar must be cooled to a certain degree in order to permit continuous casting without interruption.

The present invention provides improvements in conventional cooling systems such as described above so as to increase the efficiency of cooling of the die as well as the cast product.

OBJECTS OF INVENTION

It is an object of the present invention to provide an improved cooling system for increasing production in a continuous casting operation, and more specifically, such a system utilized for cooling the die as well as the product formed from the die. Also included herein is a novel method for cooling a die and a product cast from the die in a continuous casting operation.

Another object of the present invention is to provide a novel and improved cooling system for a continuous vertical casting operation, which cooling system utilizes two separate or independent coolant circuits which also may be supplied with different coolant mediums.

Another object of the present invention is to provide such a cooling system which will not only cool the continuously cast bar at its point of emergence from the die but also, at points within the die and closer to the solidification point of the metal within the die to thus increase overall cooling of the cast product to permit production speed to be increased.

Another object of the present invention is to provide, for use within such system, a novel cooling sleeve for a die which sleeve has increased surface contact with the coolant to increase heat exchange and cooling of the die.

Another object of the present invention is to provide a novel and improved continuous casting die and cooling sleeve which will permit coolant to be introduced within the die so as to directly engage portions of the internal surface of the die, as well as the product formed from the die.

SUMMARY OF INVENTION

Summarizing the present invention, cooling liquid such as water is directed within a cooling jacket upwardly and downwardly along the surface of a cooling sleeve which surrounds and intimately engages the die so as to extract heat from the die along the full length of the die as well as to direct the cooling liquid against the product cast from the die at the point of emergence from the latter. In achieving the foregoing, the internal space of the cooling jacket is provided with a vertical partition which not only directs the cooling liquid in the directions as desired but which also separates the cool water from the heated water. To enhance surface contact of the cooling sleeve with the coolant, the external surface of the cooling sleeve is provided with a series of spiral or helical grooves having a generally U-shape and extending substantially throughout the length of the cooling sleeve in continuous fashion.

In accordance with another aspect of the invention, cooling of the continuous cast bar is enhanced by a second cooling circuit provided independently of the one mentioned above, for introducing coolant from a source which may be separate from the source of the coolant described above, through the coolant sleeve and through the die into a plurality of grooves formed on the lower internal surface of the dye so as to contact the cast bar while within the die.

DRAWINGS

Other objects and advantages will become apparent from the following more detailed description taken in conjunction with the drawings in which.

DETAILED DESCRIPTION

Figure 1:
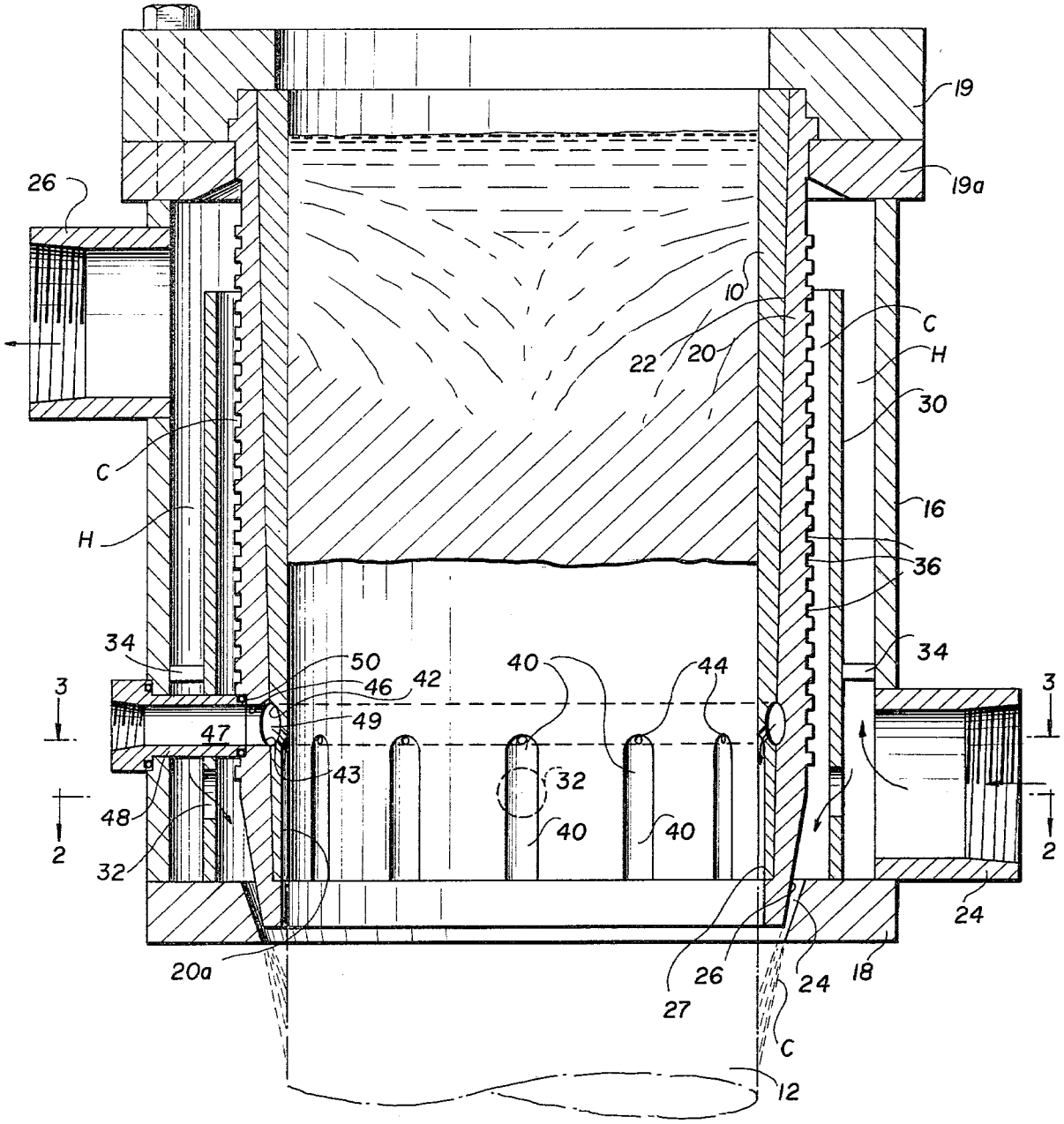
FIG. 1 is a cross-sectional, elevational view of a die and cooling assembly constituting a preferred embodiment of the present invention and with the bar which is continuously cast, shown in phantom lines.

Referring now to the drawings in detail, there is shown in FIG. 1 for illustrative purposes only, a die 10 for continuous vertical casting of a metallic product 12 which, in the shown embodiment, is a solid cylindrical bar conforming to the internal surface of the die 10 which is cylindrically configured. Molten metal is introduced in conventional manner in the top of the die in the region indicated generally at 14 and flows vertically through the die while emerging therefrom in solidified form, as a bar, shown by the phantom lines at the bottom of FIG. 1. For cooling the die as well as the cast bar 12, a cooling system is provided which includes a hollow cylindrical jacket 16 defining a space between the jacket 16 and a hollow copper cooling sleeve 20 which surrounds and intimately contacts the outer surface of the die 10 along a line indicated at 22. The internal surface of cooling sleeve 20 and the external surface of die 10 are provided with complementary tapers so as to ensure proper seating and continuous contact between these parts to enhance heat exchange; the tapered surfaces being well-known and forming no part of the present invention.

Cooling jacket 16 in the specific embodiment, has a horizontal base 18 which includes a passage through which the lower portion 26 of the cooling sleeve 20 extends with an annular space 24 formed between the base 18 and the lower portion 26 of the cooling sleeve 20 to permit cooling liquid C to pass through the base 18 into contact with the bar 12 emerging from the die as will be described further below. At the top of the cooling jacket 16 is a cover 19 which secures cooling sleeve 20 on a mounting ring 19*a* fixed to the top of cooling jacket 16. Cover 19 has a large passage for permitting molten metal to be introduced in the top of the die at region 14. Die 10 is secured within the cooler sleeve 20 by means of the tapered surfaces on the inside of cooling sleeve 20 and the outside of die 10, and also by means of a shoulder 27 formed on the inside of lower portion 26 of cooling sleeve 20; the shoulder 27 receiving the lower end of die 10 as shown in FIG. 1. Cover 19 also engages the top of die 10 to hold it in place.

In order to introduce cooling liquid, such as water into the cooling jacket, the latter is typically provided with an inlet passage defined by an inlet conduit 24 at the bottom of the jacket 16 as shown in FIG. 1. The coolant liquid introduced through the conduit 24 is discharged from the jacket through a conduit 26 located at the top of the cooling jacket 16 as shown in left-hand section of FIG. 1.

Figure 2:
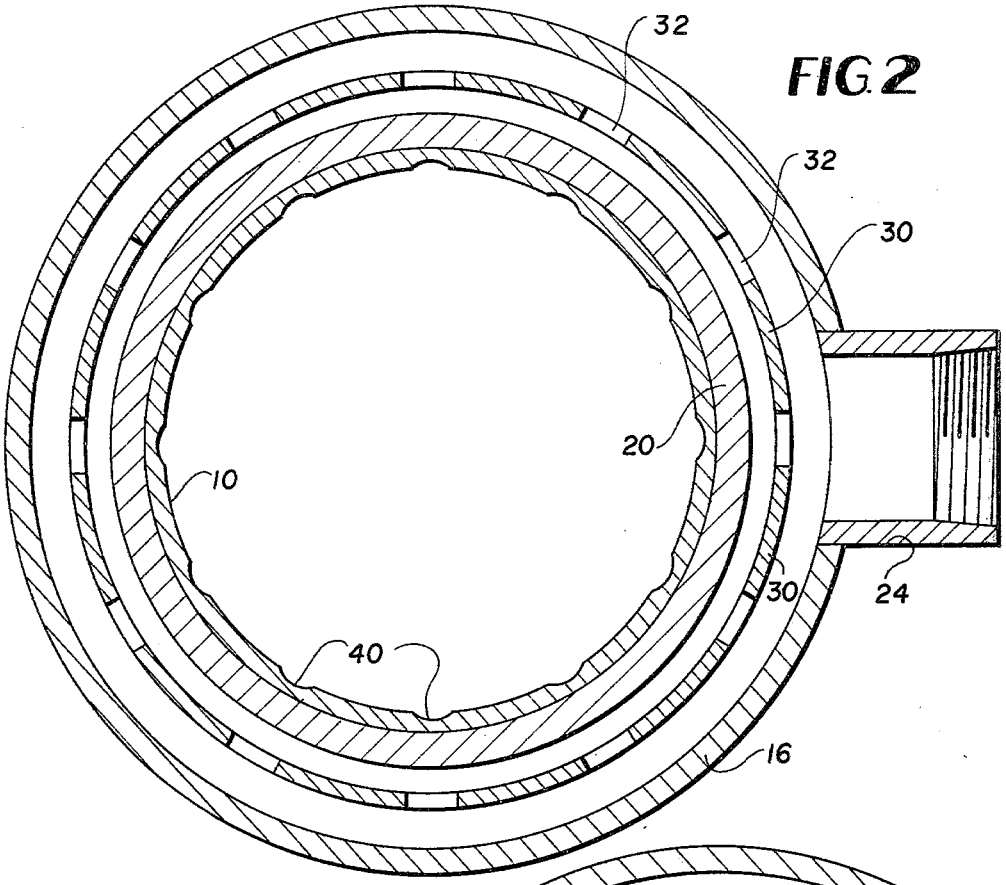
FIG. 2 is a cross-sectional view taken generally along lines 2—2 of FIG. 1.

In accordance with the present invention, an internal cylindrical partition 30 is provided within the cooling jacket 16 between the latter and the cooling sleeve 20 to divide the space into a cylindrical passage C for conducting cool water upwardly along the cooling sleeve 20 and a cylindrical passage H for accumulating heated coolant (hot water) for discharge through conduit 26. FIG. 2 shows the cylindrical nature of partition 30. Coolant liquid which enters inlet conduit 24 is introduced into passage C through means of a plurality of apertures 32 formed in the lower portion of partition 30, the plurality of apertures being shown in FIG. 2. The coolant which enters inlet conduit 24 is prevented from rising within passage H by means of a barrier 34 which is in the form of a ring fixed at the lower end of the passage H between cooling jacket 16 and partition 30 as shown in FIG. 1.

It will thus be seen that coolant entering inlet conduit 24 will pass through apertures 32 in partition 30 and move upwardly along the outer surface of cooling sleeve 20, and downwardly through the space 24 between the cooling jacket base 18 and the lower portion 26 of cooling sleeve 20 to cool the latter as well as to impinge upon the cast bar product 12 as it emerges from the die 10. The space 24 is restricted, and the pressure of the cooling liquid in conduit 24 is such that the cooling liquid will also rise in passage C along and in contact with the outer surface of cooling sleeve 20 to cool the same. Cooling liquid which is heated by virtue of contact with sleeve 20 accumulates in the passage H and will discharge from conduit 26.

In accordance with another feature of the present invention, the outer surface of cooling sleeve 20 is configured to increase its surface contact with the cooling liquid. Preferably, to this end, the outer surface of cooling sleeve 20 is provided with a continuous helical or spiral groove, forming in cross section, a plurality of generally U-shaped channels as shown in FIG. 1. This will substantially increase the surface contact of the cooling sleeve 20 by as much as fifty percent. In order to obtain the utmost surface contact between cooling sleeve 20 and the cooling liquid, it is important that channels 36 be formed in a continuous helix or spiral, rather than discontinuous grooves. This will avoid turbulence which would occur if the channels 36 were discontinuous and which turbulance would decrease contact of the coolant liquid with the outer surfaces of cooling sleeve 20. Moreover, the spiral groove formations on the cooling sleeve 20 will permit the wall thickness thereof to be decreased without sacrificing strength which is provided by the spiral groove formations. This ensures continuous contact between the cooling sleeve 20 and the die 10 which is most important to the casting operation.

Figure 3:
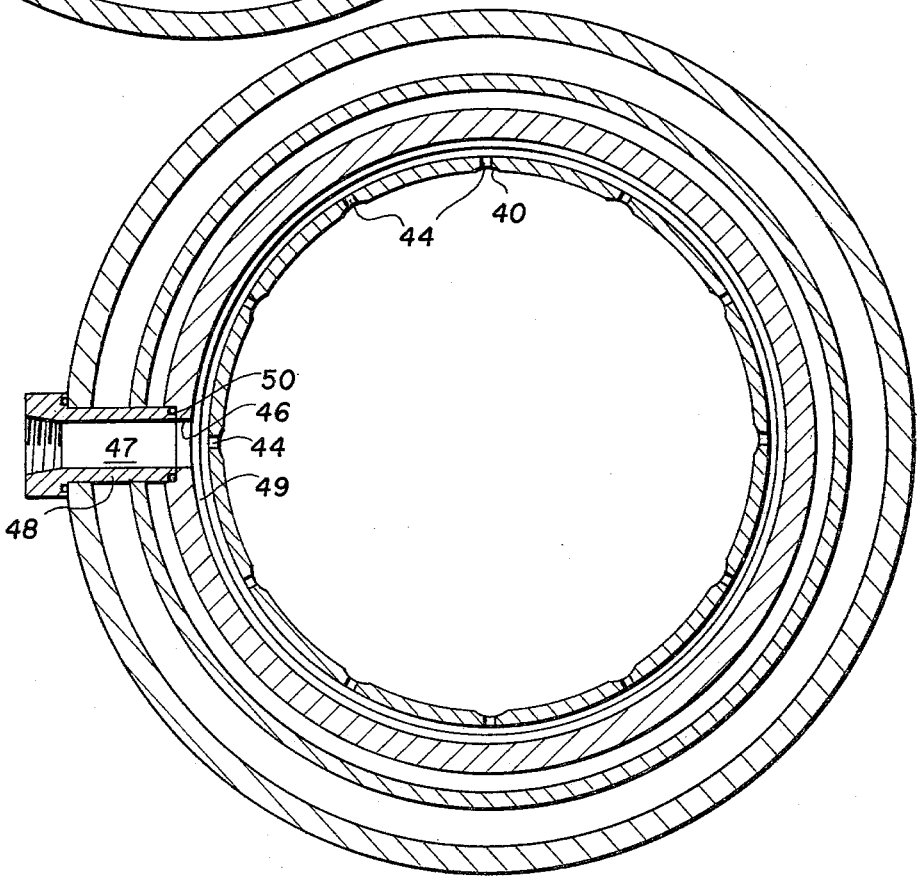
FIG. 3 is a cross-sectional view taken generally along lines 3—3 of FIG. 1.

In accordance with another aspect of the present invention, another independent coolant circuit is provided, which may be used to introduce a different type of coolant, if desired, or the same type of coolant as that which is introduced into inlet conduit 24. The coolant utilized in this independent circuit is brought into direct contact with internal surface portions of die 10 in the lower portion 20*a* of the die below the solidification point of the molten metal in the die. In the preferred embodiment shown, a plurality of longitudinally extending coolant grooves 40, as shown in FIGS. 1 and 2, are provided on the internal surface portions of the die 10 in the lower region 20*a*. Grooves 40 are equi-angularly spaced circumferentially about portion 20*a* of the die 10 and extend to the lower end of the die as shown in FIG. 1. Coolant fluid to be introduced into grooves 40 is introduced into the system by means of one or more inlets 48 (one shown) which have a passage 47 communicating with an aperture 46 in cooling sleeve 20. Aperture 46 communicates with opposed registering grooves 42 and 43 formed respectively in the outer surface of die 10 and inner surface of cooling sleeve 20 as shown in FIG. 1. Grooves 42 and 43 define an annular coolant passage 49 for introducing coolant from inlet passage 47 into the grooves 40 through a series of circumferential apertures 44 which extend through the die 10 between annular passage 49 and grooves 40. As shown in FIGS. 1 and 3, there is an aperture 44 provided for each of the coolant grooves 40.

It is preferred that the coolant introduced into inlet 48 be from a circuit which is separate from that which is introduced into inlet 24. A valve and other control components for the coolant circuit, although not shown, may be provided. In order to seal and separate the coolant which is introduced through inlet 48 from the coolant introduced through inlet 24 in the situation where different coolant mediums are utilized, a suitable seal such as O-rings 50 may be provided to seal the inner end of inlet 48 against the outer surface of cooling sleeve 20, as shown in FIGS. 1 and 3.

It will be seen from the above that the coolant introduced into inlet 48 will be conveyed into grooves 40 and directly onto the outer surface of the cast bar 12 to cool the same starting at the top of grooves 40 which is relatively close but below the solidification level SL (FIG. 1) of the molten metal in the die 10 to thus enhance the cooling of the cast bar 12 which, in turn, will allow the production speed to be significantly increased. In FIG. 1, the upper level of the molten metal to be cast is designated ML. It is preferred that apertures 44 extend downwardly at an angle of about 45° to direct the coolant liquid downwardly into grooves 40. Although twelve cooling grooves 40 are provided in the die 10 shown, a greater or lesser number may be provided depending on the amount of cooling desired, the size and strength characteristics of the die 10, and the material of the product 12 cast.

What is claimed is:

1. A die and cooler assembly for use in a continuous vertical casting operation, the assembly comprising, a vertical die having a vertical bar forming passage for receiving molten material and for casting the same into a product, with the product emerging from the bottom of the die, and a cooling sleeve surrounding and in engagement with the die throughout a substantial portion thereof, a cooling jacket surrounding the cooling sleeve and defining therewith a space for receiving coolant, said cooling sleeve having substantially throughout its outer surface a plurality of annular channels for receiving coolant, and wherein said annular channels in the cooling sleeve extend continuously in helical fashion for conveying coolant in contact with the cooling sleeve substantially uniformly throughout a substantial length of the cooling sleeve, and wherein there is further included partition means surrounding and spaced from the cooling jacket and defining a first coolant passage between the partition means and the cooling sleeve, a first inlet means including an inlet port in a lower part of the jacket and a port in the partition for introducing a coolant into the first coolant passage, an outlet port in an upper part of the jacket for discharging coolant, and wherein the cooling sleeve at its lower end is spaced from the cooling jacket to define a passage between the sleeve and the jacket communicating with the port in the partition for permitting coolant to impinge against the cast product emerging from the die, and wherein there is further included a barrier extending between the partition means and the cooling jacket preventing coolant from the inlet port from flowing upwardly into the space between the partition means and the jacket, and wherein said channels in the cooling sleeve are helical grooves formed in the sleeve and having a generally U-shaped cross section, and wherein said die has, on its inner lower surface, at least one coolant passage formed therein, and wherein there is further included a coolant passage means extending through the coolant sleeve and the die and communicating with said coolant passage in the die for conveying coolant to the inner surface of the die and the outer surface of the cast product, and wherein there is further included another inlet in the jacket for introducing coolant into said coolant passage means and to said coolant passage on the inner surface of the die independently of the coolant introduced in said first inlet, said coolant passage means being isolated from communication. with the space between the jacket and the sleeve.

* * * * *